US009387913B1

(12) United States Patent
Dye

(10) Patent No.: US 9,387,913 B1
(45) Date of Patent: Jul. 12, 2016

(54) MODULAR FLOATING DRY DOCK

(71) Applicant: Wayne Kenneth Dye, Scappoose, OR (US)

(72) Inventor: Wayne Kenneth Dye, Scappoose, OR (US)

( * ) Notice: Subject to any disclaimer, the term of this patent is extended or adjusted under 35 U.S.C. 154(b) by 0 days.

(21) Appl. No.: 15/048,899

(22) Filed: Feb. 19, 2016

Related U.S. Application Data

(63) Continuation of application No. 14/639,094, filed on Mar. 4, 2015, now Pat. No. 9,266,590.

(51) Int. Cl.
*B63C 1/02* (2006.01)
*B63B 3/08* (2006.01)

(52) U.S. Cl.
CPC .... *B63C 1/02* (2013.01); *B63B 3/08* (2013.01)

(58) Field of Classification Search
CPC ..... B63C 1/02; B63B 3/08
USPC ..... 114/46
See application file for complete search history.

(56) References Cited

U.S. PATENT DOCUMENTS 4,479,450 A * 10/1984 Lundberg ..... B63C 1/04 114/125
4,955,308 A * 9/1990 Craddock ..... B63C 1/02 114/45
5,111,764 A * 5/1992 D'Ettorre ..... B63B 35/003 114/259
5,138,963 A * 8/1992 Eichert ..... B63B 59/045 114/222
5,269,246 A * 12/1993 Goldbach ..... B63B 3/20 114/45
7,255,055 B2 * 8/2007 Whybourne ..... B63B 3/08 114/263
7,509,916 B1 * 3/2009 Nelson, Jr. ..... B63C 1/02 114/45
7,603,959 B1 * 10/2009 Veazey ..... B63B 3/08 114/263
8,858,149 B2 * 10/2014 Munson, Jr. ..... B63B 35/44 114/259
2003/0140837 A1 * 7/2003 O'Neil ..... B63C 1/02 114/259
2007/0283866 A1 * 12/2007 Veazey ..... A01K 61/005 114/77 R

OTHER PUBLICATIONS

U.S. Patent and Trademark Office, First Action Interview Pilot Program Pre-Interview Communication in U.S. Appl. No. 14/639,094, which this U.S. application claims the benefit of priority.

* cited by examiner

*Primary Examiner* — Lars A Olson
*Assistant Examiner* — Jovon Hayes
(74) *Attorney, Agent, or Firm* — Kolisch Hartwell, P.C.

(57) ABSTRACT

Systems and methods may include an enclosable, modular floating dry dock, which may comprise a plurality of floodable flotation modules coupled to a central support member at spaced intervals, such that gaps are formed between successive flotation modules. Each gap may be spanned by a deck and/or wall. A working volume may be defined between an interior of the floating dry dock and a supported watercraft. The working volume may be environmentally enclosed by drapes coupled to the dry dock.

20 Claims, 7 Drawing Sheets

MODULAR FLOATING DRY DOCK

CROSS-REFERENCE TO RELATED APPLICATION

This is a continuation of U.S. Non-Provisional application Ser. No. 14/639,094 filed Mar. 4, 2015, the entirety of which is incorporated herein by reference for all purposes.

FIELD

This disclosure relates to systems and methods for placing a watercraft into dry dock and supporting it therein. More specifically, the disclosed embodiments relate to enclosed, modular floating dry docks.

INTRODUCTION

Watercraft of all shapes and sizes require maintenance and repairs from time to time. These activities sometimes require the vessel to be removed from the water. For example, work on the exterior hull of a boat (e.g., painting) may be impossible or difficult when the hull is in the water. In some cases, repairs or upgrades to a watercraft requires breaching the hull. This is impractical and inadvisable if the watercraft is floating in the water. Accordingly, various methods for conducting such work have been devised over the centuries. Smaller vessels may be lifted out of the water by a crane or davit, and work may be conducted either on land or onboard a larger vessel. Larger watercraft, such as ships and oceangoing boats, may be removed from the water using a dry dock. Dry docks fall into two main categories: floating and non-floating. Non-floating dry docks are essentially basins formed either on shore or attached to a shoreline. A vessel may be floated into the basin, and then the basin is drained, leaving the ship on a dry platform. In other words, the basin of a non-floating dry dock is a stationary receptacle capable of being emptied by pumping water out.

A floating dry dock, on the other hand, is designed to be partially sunk. A floating dry dock typically has a U-shaped cross section and floodable flotation chambers. When the deck of the floating dry dock is submerged, a watercraft may be positioned over the deck by simply driving it into position. The dry dock is then raised under the vessel by pumping or otherwise forcing water out of the flotation chambers. Water above the deck exits via the open ends of the U-shaped structure, until both the deck and the vessel are above the waterline. One advantage floating dry docks have is the ability to be geographically relocated.

However, floating dry docks for ships are typically quite large, and do not accommodate medium sized boats in the 60- to 80-ton range. Standard floating dry docks may be resized by hooking dry dock sections together. However, combining large dry docks into larger dry docks is not a feasible solution for boat and yacht owners who desire a customized dry dock for their watercraft. Additionally, because of their open-air design, standard floating dry docks have environmental impact issues. Debris, particulate, and both liquid and airborne contamination are frequently released into the surrounding waters.

SUMMARY

The present disclosure provides systems, apparatuses, and methods relating to modular floating dry docks. In some examples, a method of limiting environmental impact when performing work on a watercraft may include raising a watercraft out of a body of water using a floating dry dock having a pair of wing walls and a plurality of floodable transverse flotation tanks disposed at lower end portions of the pair of wing walls at spaced intervals along a length of the floating dry dock, a weight of the floating dry dock being at least partially offset by one or more self-buoyant floats coupled to the floating dry dock; enclosing a working volume between an outer portion of the watercraft and an inner portion of the dry dock by coupling one or more flexible sheets to the dry dock and to the watercraft; ventilating the working volume using a forced ventilation system configured to maintain an internal pressure in the working volume lower than an external atmospheric pressure; and containing debris generated within the working volume using the outer portion of the watercraft, the inner portion of the dry dock, and the one or more flexible sheets.

In some examples, a method of environmentally segregating a watercraft from a body of water may include raising a watercraft out of a body of water using a floating dry dock, a weight of the dry dock being at least partially offset by one or more self-buoyant floats coupled to the dry dock; supporting the watercraft on the floating dry dock on one or more keel blocks between a pair of wing walls above a substantially continuous floor comprising a deck and a plurality of transverse tanks; and reducing contamination of the body of water from the watercraft by enclosing a working volume, such that an outer boundary of the working volume is formed by an inner portion of the floating dry dock.

In some examples, a method for limiting environmental contamination when performing work on a watercraft may include supporting a watercraft above a body of water on a keel support assembly of a floating dry dock having a plurality of controllably floodable transverse flotation tanks coupled at spaced intervals to the keel support assembly along a length of the floating dry dock, a plurality of naturally buoyant floats being disposed below the keel support assembly, such that a buoyancy of the plurality of naturally buoyant floats at least partially offsets a weight of the floating dry dock; and preventing debris from passing from the watercraft into the body of water by enclosing a working volume between the watercraft and an interior portion of the floating dry dock.

Features, functions, and advantages may be achieved independently in various embodiments of the present disclosure, or may be combined in yet other embodiments, further details of which can be seen with reference to the following description and drawings.

DESCRIPTION

Overview

Various embodiments of a modular floating dry dock having improved environmental impact prevention are described below and illustrated in the associated drawings. Unless otherwise specified, a floating dry dock and/or its various components may, but are not required to, contain at least one of the structure, components, functionality, and/or variations described, illustrated, and/or incorporated herein. Furthermore, the process steps, structures, components, functionalities, and/or variations described, illustrated, and/or incorporated herein in connection with the present teachings may, but are not required to, be included in other similar dry docks. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

In general, a modular floating dry dock may include a selected plurality of U-shaped composite tank structures arranged at spaced intervals and connected by bracing members, central I-beams, and walkways. The number of tank structures, also referred to herein as pontoons, may be selected based on the size of watercraft to be accommodated. Furthermore, a modular floating dry dock may include features providing a significantly reduced environmental impact. For example, dry docks are typically used to support a watercraft for maintenance and repair activities that produce liquid, solid, and/or airborne contaminants. A floating dry dock in accordance with aspects of the present disclosure may include one or more enclosure and/or containment features that prevent or greatly reduce the release of such contaminants to the surrounding environment.

Figure 1:
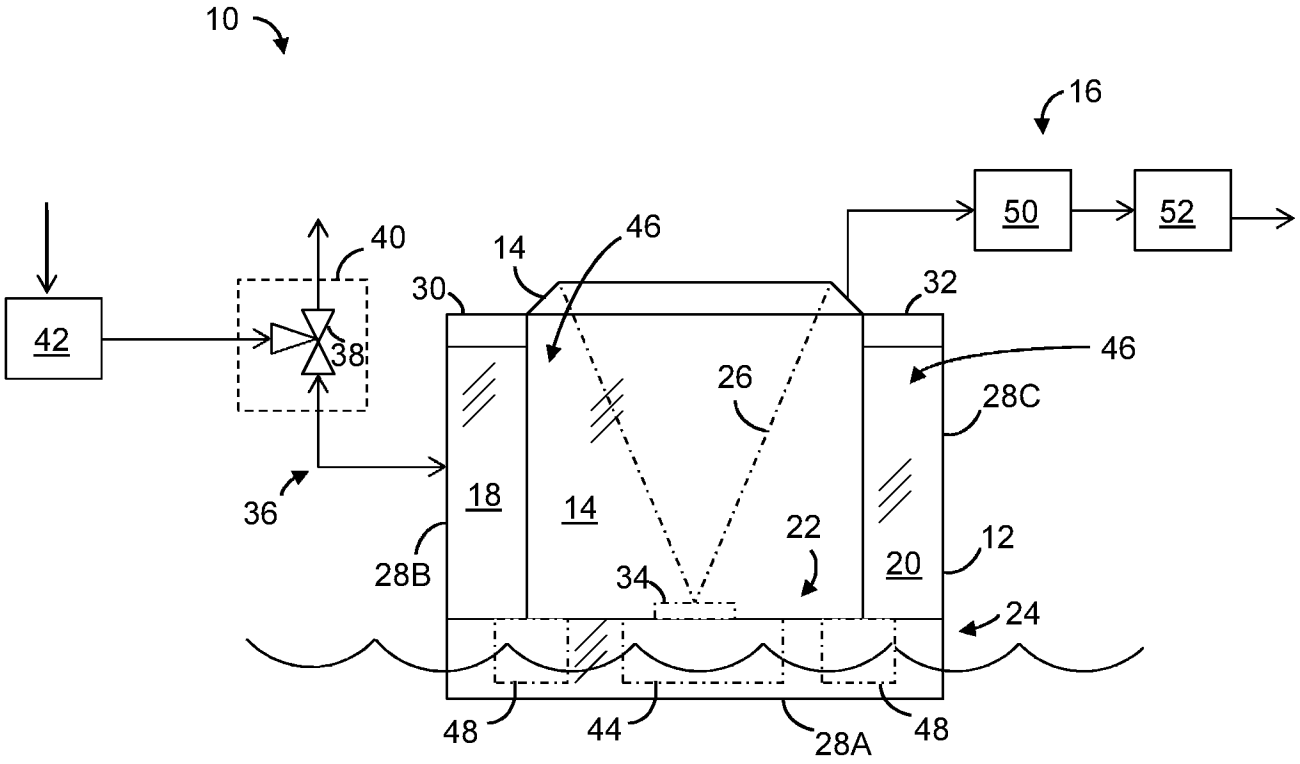
FIG. 1 is a schematic diagram depicting an end elevation view of an illustrative floating dry dock supporting a watercraft.

Turning to FIG. 1, a schematic diagram of a modular, enclosed, floating dry dock system 10 is depicted. Dry dock system 10 may include a floating dry dock 12, one or more enclosure drapes 14, and a ventilation system 16. Floating dry dock 12 may include a pair of wing walls 18, 20 connected by a deck 22. The dry dock may be supported by a plurality of U-shaped flotation modules 24 (also referred to as tanks or tank assemblies) coupled to deck 22 and/or wing walls 18, 20. In some examples, flotation modules 24 form a portion of the deck and/or wing walls.

The size and lifting capacity of floating dry dock 12 may be determined at least in part by the selected number of flotation modules 24. For example, five flotation modules may be selected to support a watercraft 26 of a certain size and weight. In other embodiments, watercraft 26 may be smaller and lighter, and four flotation modules may be utilized. Accordingly, floating dry dock system 10 may be scalable or variable within a range of sizes. In some embodiments, floating dry dock 12 may be configured to raise and support an expected size and type of watercraft (e.g., an 80-ton boat).

Each flotation module 24 may include one or more tanks 28 (also referred to as tank portions). For example, as shown in FIG. 1, flotation module 24 may include a transverse tank 28A, a first upright tank 28B, and a second upright tank 28C. The upright tanks may be coupled or affixed to an upper surface of the transverse tank, as shown in FIG. 1. In other embodiments, the transverse tanks may be affixed to the ends of the transverse tank. In some embodiments, flotation module 24 may comprise a single tank.

A pair of walkways 30, 32 may be disposed atop wing walls 18, 20, such that walkway 30 spans the upper ends of upright tanks 28B and walkway 32 spans the upper ends of upright tanks 28C. Walkways 30 and 32 may include any suitable structure configured to provide a walking surface for persons, and may include mooring features for securing watercraft 26 (e.g., bitts, bollards, and/or the like). The walkways may include other suitable features, such as handrails.

Watercraft 26 may include any suitable waterborne vessel or craft, such as a boat, a ship, or the like. Floating dry dock 12 may include a keel support 34. Keel support 34 may include any suitable structure configured to contact a lower portion of watercraft 26 and support the weight of the watercraft when raised out of the water. For example, keel support 34 may include a plurality of transverse beams or blocks disposed along a central long axis of the dry dock. One or more beams or other support members may run along the central long axis to provide additional support and connectivity between flotation modules.

Raising (i.e., floating) and lowering (i.e., sinking) of floating dry dock 12 may be facilitated by a pneumatic system 36 configured to vent or pressurize flotation modules 24. Pneumatic system 36 may be manipulated using control valves, represented here by a valve 38. A plurality of such valves or valve controllers may be arranged at a control panel 40 for operation at a single location. Each valve 38 may include one or more pneumatic valves. In some embodiments, valve 38 may include a three-way valve and/or a butterfly shut-off valve. To pressurize the flotation modules, or a portion thereof (e.g., a transverse tank portion), air may be blown or pumped into the tank by a blower 42 through valve 38 and pneumatic system 36. Blower 42 may include any suitable air compressor or blower.

To assist in raising watercraft 26, the weight of floating dry dock 12 structures may be partially or completely offset by supplemental floats 44. Floats 44 may include any suitable naturally buoyant structure configured to contribute buoyancy to the dry dock when attached thereto, and to partially offset the weight of the dry dock structure. For example, floats 44 may include one or more closed-cell foam blocks. Foam blocks (e.g., Styrofoam blocks) may be encased in plastic (e.g., by shrink-wrapping) for waterproofing and structural integrity. Floats 44 may be disposed in any suitable location on the dry dock. In some embodiments, floats 44 may be placed between flotation modules. In some embodiments, floats 44 may be placed under the keel support area, as indicated in FIG. 1.

To facilitate environmental containment of debris and particulates, gaps between flotation modules 24 may be filled by decking and walls (not shown in FIG. 1). Additionally, drapes 14 (also referred to as sheets) may be placed over the otherwise open ends of the dry dock (at 14A) and over openings between watercraft 26 and wing walls 18 and 20 (at 14B and 14C). Sheets or drapes 14 may include any suitable flexible structure configured to be generally impermeable to liquids (e.g., water) and gasses (e.g., air). For example, drapes 14 may include one or more plastic or vinyl tarps. In some embodiments, portions of drapes 14 may be affixed to floating dry dock 12. In some embodiments, drapes 14 may be selectively attached to portions of dry dock 12 by fasteners and fastening systems included for that purpose. In some examples, drapes 14 may pass completely over the watercraft, enclosing the watercraft in the dry dock. In some examples, drapes 14 may pass from an outer perimeter of the watercraft to the dry dock, thereby enclosing a space 46 between the craft and the interior of the dry dock. Space 46 includes the area where work is typically performed by persons and machinery in the dry dock, such as on the hull of watercraft 26. Accordingly, the enclosed space 46 may be referred to as the working volume.

The walls, decks, flotation modules, and sheets of system 10 function to contain debris and particulate matter, as well as airborne contamination. Liquids used or produced within the enclosed dry dock may be retained in any suitable structure, such as one or more sumps 48. These liquids, which may contain contaminants, may be stored or held until pumped out of the dry dock to suitable containers or processing systems.

Airborne particulates and contaminants may be handled by ventilation system 16. Ventilation system 16 may include a ventilation fan 50 and a scrubber 52. Air from enclosed volume 46 may be exhausted through the fan and scrubber. In some embodiments, make-up or supply air may be provided by a supply fan. In some embodiments, make-up air may be pulled into the enclosed volume through the action of fan 50. A slight pressure differential may be maintained, such that the air pressure inside enclosed space 46 may be slightly lower than atmospheric pressure outside the space. This arrangement helps prevent undesired escape of airborne contamination from the enclosed space.

Examples, Components, and Alternatives

The following sections describe selected aspects of exemplary modular floating dry docks as well as related systems and/or methods. The examples in these sections are intended for illustration and should not be interpreted as limiting the entire scope of the present disclosure. Each section may include one or more distinct inventions, and/or contextual or related information, function, and/or structure.

Section 1:

As shown in FIGS. 2-5, this section describes an enclosable, modular, floating dry dock 100. Dry dock 100 is an example of dry dock 10, described above. Accordingly, similar components may be labeled with similar reference numbers.

Figure 2:
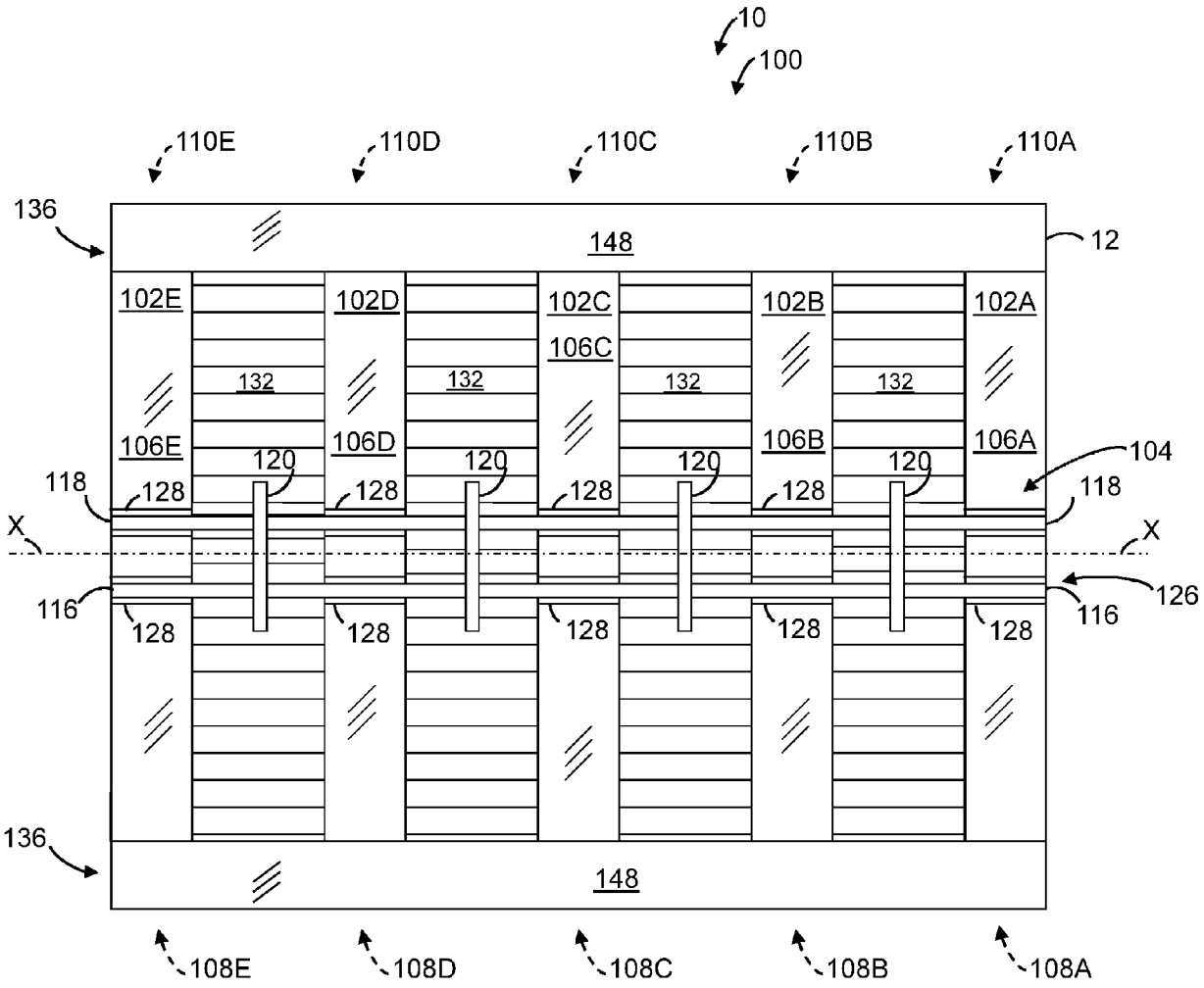
FIG. 2 is an overhead plan view of an illustrative floating dry dock in accordance with aspects of the present disclosure.
Figure 3:
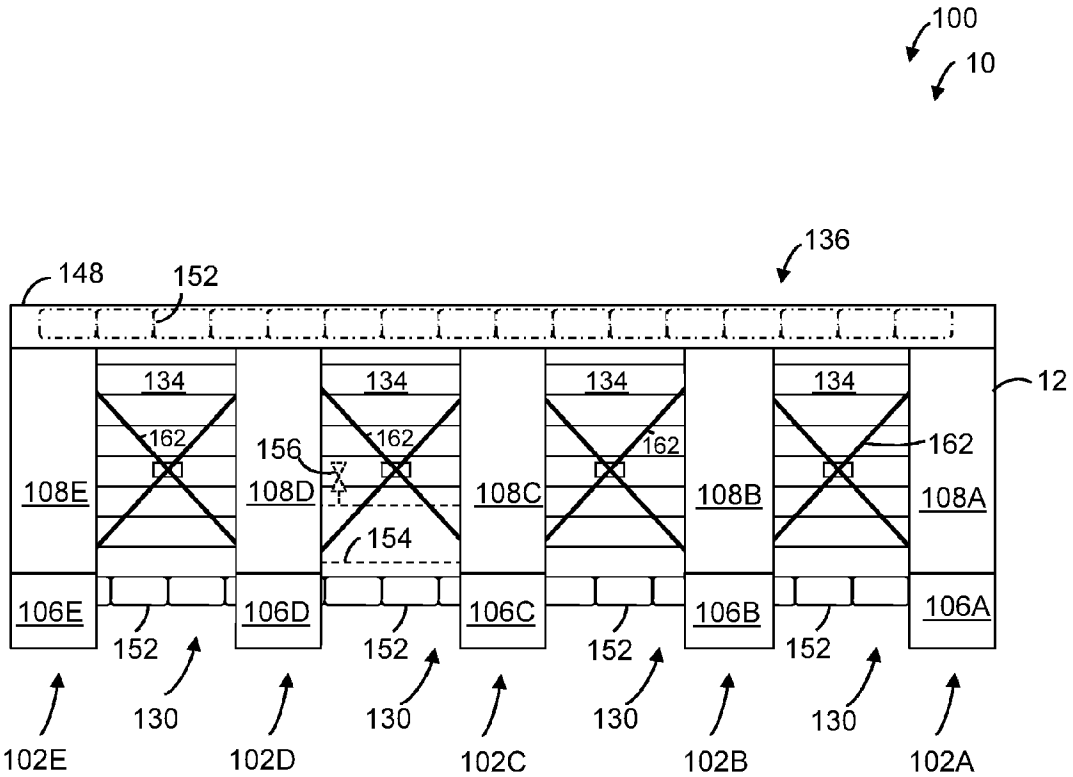
FIG. 3 is a side elevation view of the floating dry dock of FIG. 3.
Figure 4:
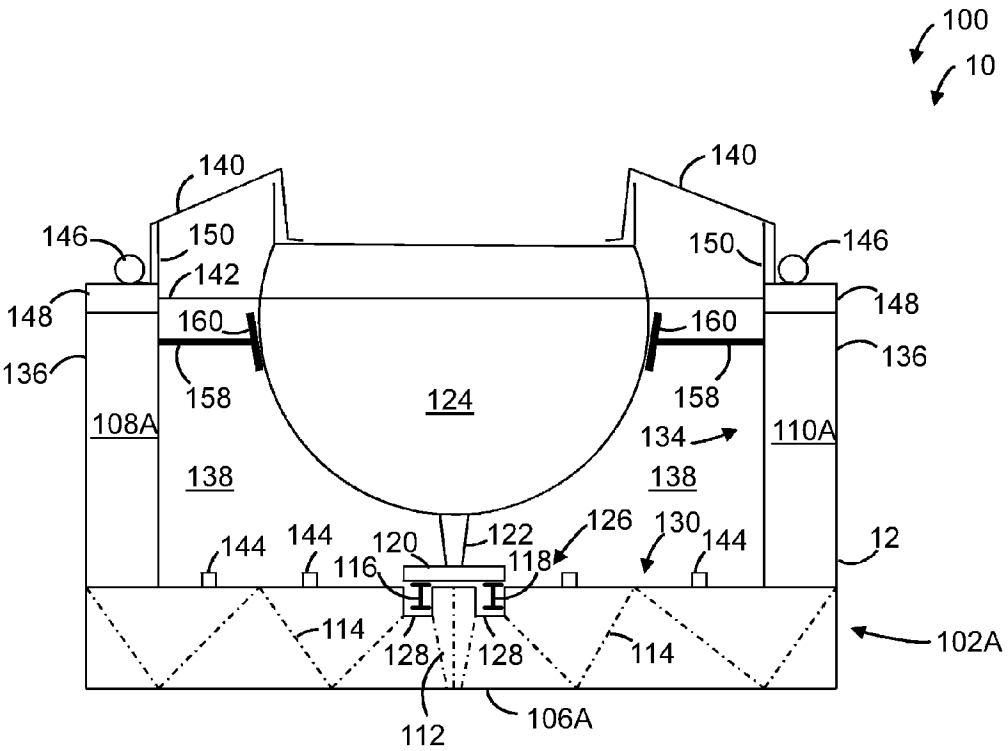
FIG. 4 is an end elevation view of the floating dry dock of FIG. 3 with an illustrative watercraft supported thereon.
Figure 5:
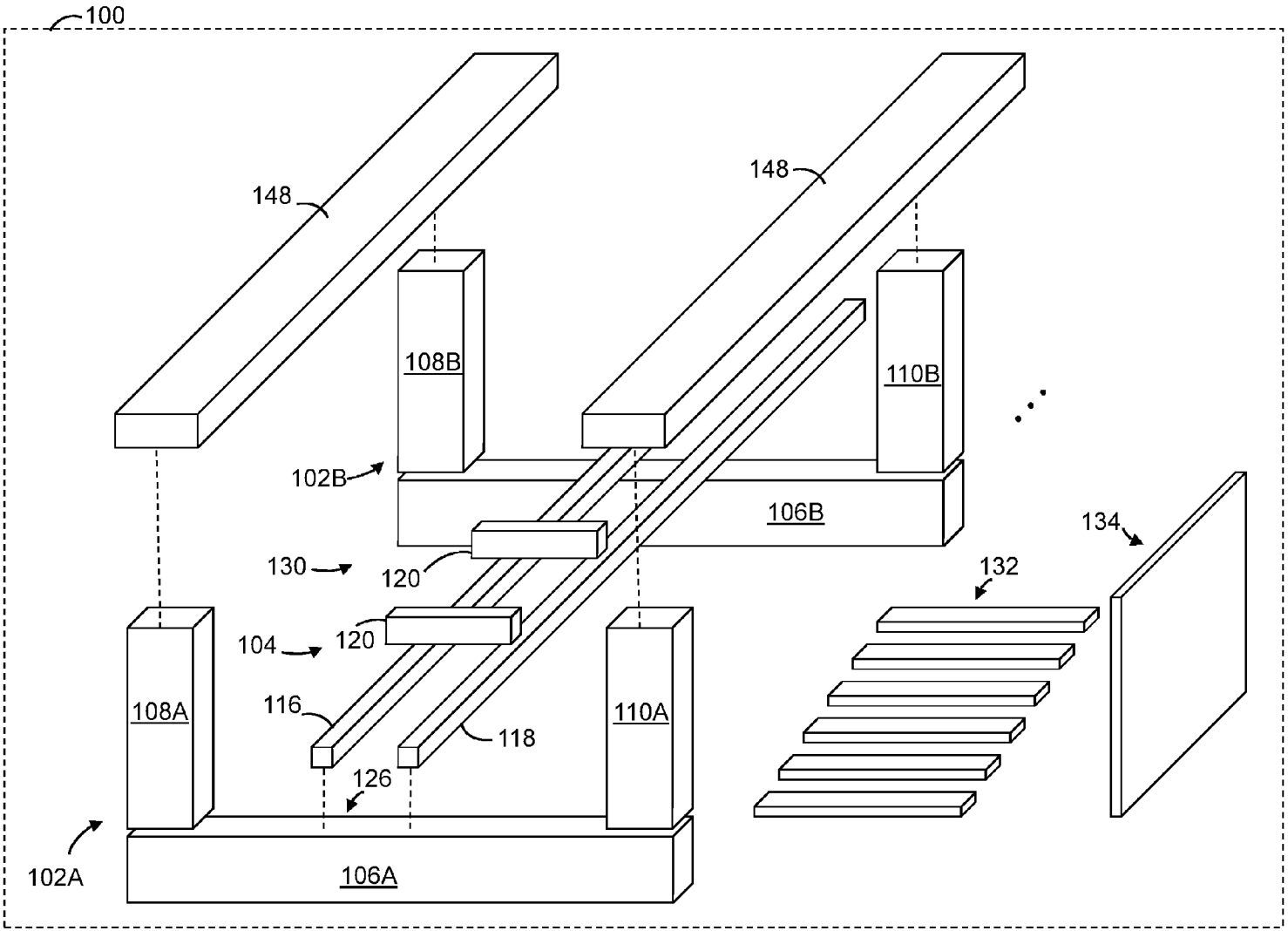
FIG. 5 is an isometric exploded schematic view of an illustrative floating dry dock in accordance with aspects of the present disclosure.

FIG. 2 is an overhead view of dry dock 100, showing the arrangement of flotation modules and decking material, as well as a keel support assembly. FIG. 3 is a side elevation view of dry dock 100, showing the flotation modules, wall coverings, braces, and placement of supplemental buoyancy and stability components. FIG. 4 is an end elevation view, showing structures of a flotation module, as well as including a watercraft and various drape-related elements. FIG. 5 is an exploded schematic view showing relationships between various components of dry dock 100.

Floating dry dock 100 includes a series of substantially identical flotation modules 102 coupled to a keel support assembly 104. In the embodiment shown in FIGS. 2-5, floating dry dock 100 includes five flotation modules, 102A, 102B, 102C, 102D, and 102E. However, any suitable number of flotation modules 102 may be selected. For example, more or fewer flotation modules may be selected, based on the length and/or displacement of the watercraft to be supported.

Each flotation module 102 may include any suitable structure and/or apparatus configured to provide a selected amount of floodable buoyancy. In some embodiments, flotation module 102 may include submodules, partitions, or tank portions. For example, each of the flotation modules depicted in FIGS. 2-5 may comprise a U-shaped structure including a transverse tank 106A-106E, a first upright tank 108A-108E, and a second upright tank 110A-110E. Primary buoyancy may be provided by the transverse tanks. The upright tanks may provide primary and reserve buoyancy, as well as stability when the transverse tanks are submerged.

Each transverse tank may include an elongate rectangular tank oriented athwart keel support assembly 104. Although rectangular tanks are described and depicted in the drawings, any given tank may be any suitable shape. For example, a transverse tank may be cylindrical or polygonal. Transverse tanks 106A-106E may comprise any suitable flotation tank material configured to provide structural and weight-bearing support for the overall dry dock system. For example, a transverse tank may comprise steel, stainless steel, composite material, or the like, or a combination thereof.

Keel support assembly 104 defines a central long axis X of dry dock 100 (see FIG. 2). The transverse tanks may be described as being oriented transverse or laterally perpendicular to long axis X. In some embodiments, such as the one shown in FIGS. 2-5, each transverse tank 106A-106E, and therefore each flotation module 102A-102E may be centered on long axis X. In some embodiments, each transverse tank may comprise a rectangular tank, 36-feet long (in a dimension perpendicular to the X axis) by four feet tall (i.e., high), by six feet wide (i.e., in a dimension parallel to the X axis).

The transverse tanks, being floodable, will from time to time be partially flooded. To reduce the instability caused by the free surface effect in an elongate tank, each of the transverse tanks may include one or more internal bulkheads and/or baffles. For example, referring to flotation module 102A in FIG. 5, each transverse tank may include a central bulkhead 112. Being coupled to keel support assembly 104, the transverse tanks will also bear the weight of the watercraft. Various features may be included to facilitate this weight-bearing functionality. Reinforcing frames, also referred to as braces and/or ribs 114 may be attached to inner and/or outer walls of transverse tanks 106A-106E to distribute the weight of the watercraft and related forces along the length of the tanks, thereby preventing concentration at a center portion. For example, ribs 114 may include angle iron segments welded to one or more walls of the tanks. Similar features may be included in other tanks or tank portions.

Upright tanks 108A-108E and 110A-110E may include any suitable structure configured to provide buoyancy and stability to floating dry dock 100. Upright tanks 108A-108E may be floodable, and may partially submerge during operation of the dock. In some embodiments, each upright tank may be approximately eight feet tall, with a four-foot by six-foot rectangular base. Upright tanks 108A-108E may be interchangeably referred to as wing tanks. As mentioned above, each pair of side wing tanks may be disposed in a U-shaped arrangement with a transverse tank at their base. In some embodiments, as depicted in FIGS. 2-5, upright tanks 108A-108E and 110A-110E may be connected to respective upper surfaces of transverse tanks 106A-106E. In some embodiments, the upright tanks may be connected to end surfaces of the transverse tanks. Any suitable connection geometry may be used. For each flotation module 102, two upright tanks may be fastened to the transverse tank. For example, the upright tanks may be connected to the transverse tank by welding, fusing, adhering, riveting, bolting, strapping, or the like, or any combination thereof.

Keel support assembly 104 may include any suitable structure configured to provide a central spine for coupling with the flotation modules and to support the weight of an expected watercraft. For example, keel support assembly 104 may include a pair of side-by-side elongate members 116, 118 running parallel to central axis X. In some embodiments, a single elongate member may be present. Elongate members 116, 118 may include any suitable beam or structural element. For example, elongate members 116, 118 may comprise I-beams. For example, twelve-inch steel I-beams may be used. Each elongate member may include one or more I-beams. For example each elongate member may include a plurality of similar I-beams welded end to end to form a single I-beam running the length of the dry dock.

Keel support assembly 104 may include a plurality of keel blocks 120 arranged at spaced intervals along the length of elongate members 116 and 118. Keel blocks 120 may be oriented transverse to central axis X to better support a keel 122 of a watercraft 124. Keel blocks 120 may include any suitable structure configured to collectively support keel 120 of watercraft 124. Keel blocks 120 may include blocks, beams, pedestals, or the like, or any combination of these. In the embodiment shown in FIGS. 2-5, keel blocks 120 include I-beams that lie across and are attached to elongate members 116 and 118. For example, keel blocks 120 may include six-inch I beams, each approximately four feet long and tack welded to the I-beams of members 116 and 118. Keel blocks 120 may be sized and shaped to withstand a predetermined amount of supported weight. Each of the keel blocks 120 may be configured with a breaking point, at which point an individual keel block is designed to fail. For example, each keel block 120 may be configured to fail at approximately twenty tons. This feature enhances the safety of floating dry dock 100 by ensuring that any single point of excess pressure on keel support assembly 104 will be distributed along the elongate members. For example, if an object were to be stuck to keel 122, and the object came into contact with keel support assembly 104, the point of contact would experience a proportionally greater load than expected. Rather than possibly bending elongate members 116 and/or 118, contact with a single keel block 120 will simply cause the individual keel block to fail, allowing the rest of the keel to rest on the remaining keel blocks and distributing the load.

Keel support assembly 104 is supported by and coupled to the transverse tanks of flotation modules 102. Accordingly, each transverse tank 106A may include a mounting interface 126 configured to facilitate coupling. For example, mounting interface 126 may include one or more channels 128 (also referred to as recesses or tracks) running parallel to central axis X across the axial width of each transverse tank. Elongate members 116, 118 may be at least partially disposed and secured in channel(s) 128. For example, elongate members 116 and 118, in the form of I-beams, may be welded, clamped, or otherwise secured in the respective channels of the plurality of transverse tanks. When so connected, the flotation modules may be described as a plurality of U-shaped pontoons disposed in a spaced relationship along the central axis, each transverse tank being coupled to the pair of elongate members such that a respective gap is formed between each pair of adjacent pontoons.

Accordingly, a plurality of gaps 130 exist between each pair of adjacent flotation modules 102. In some embodiments, each gap may be approximately eight feet, as measured along the X axis. Each gap 130 includes a first void 130A between transverse tanks on successive modules and a second void 130B between upright tanks on successive modules. Each gap 130 may be covered by a layer of any suitable material. Specifically, first void 130A may be covered by a deck 132 and second void 130B may be covered by a wall 134.

Deck(s) 132 and wall(s) 134 may comprise any suitable structure or combination of structures configured to contain debris, particulate, and/or liquids generated within dry dock 100, and to form a portion of the enclosure when the dry dock is environmentally enclosed. For example, deck 132 and/or wall 134 may comprise a unitary layer (e.g., steel plate, plywood), a plurality of decking material arranged in a layer (e.g., planks), or the like, or any combination thereof. In the embodiment shown in FIGS. 2-5, deck(s) 132 and wall(s) 134 comprise decking planks. Suitable planks include composite wood/plastic decking. Off-the-shelf decking may be suitable and may facilitate the modular and customizable nature of dry dock 100. For example, decking materials currently available under the Trex® decking brand may be suitable.

In some examples, deck 132 and/or wall 134 may cover gaps 130 and one or more of the flotation modules or portions thereof. For example, deck 132 may be substantially continuous along the length of the dry dock. Deck 132 and/or wall 134 may be disposed between consecutive flotation modules 102. Accordingly, deck 132 and wall 134 may be referred to as interstitial layers, interstitial decks, and/or interstitial walls. Regardless of whether continuous or interstitial, deck(s) 132 and wall(s) 134 may be disposed on and/or attached to supportive framework configured to support the layer. Together with upright tanks 108A-108E and 110A-110E, wall(s) 134 form a pair of wing walls 136.

To facilitate environmental enclosure, i.e., prevent escape of contaminants, any deck 132 or wall 134 including more than one component (e.g., a plurality of boards or planks) may include filler material such as caulking. Any suitable caulk or other filler material may be used to permanently or semi-permanently fill cracks, gaps, and spaces between deck and wall coverings.

A working volume 138 may be enclosed around all or a portion of watercraft 124 using one or more drapes 140. As described above, drapes 140 may include any suitable flexible structure or material configured to cover or enclose the spaces around watercraft 124, such that the atmosphere of the working volume is contained environmentally. Drapes 140 may include one or more tarpaulins (i.e., tarps), drop cloths, plastic sheeting, tenting material, canopies, and the like, or any combination of these. Drapes 140 may comprise flexible PVC, treated canvas, vinyl, nylon, and/or any other suitable material that is substantially impermeable to air and water. Although drapes 140 may be configured to enclose working volume 138, relatively small gaps or spaces may exist between drape portions or between drapes 140 and other structures of dry dock 100. These gaps or spaces may be acceptable as a source of make-up air and because an attached ventilation system may maintain a negative differential pressure, preventing the exit of airborne contaminants from within working volume 138.

Dry dock 100 may include various features configured to secure, shape, or attach drapes 140. For example, fore and aft ends of the dry dock may include a transverse cable 142 strung from wing wall to wing wall. Drapes 140 may be laid over cable 142 and secured to transverse tank 106A (or 106E) using one or more tie-down points 144. For lateral drapes 140 that are placed along the beam of watercraft 124, the drapes may be held down by any suitable method. For example, as shown in FIG. 4, one or more sand bags or elongate sand-filled tubes may be laid atop an edge portion of drapes 140 to secure the drapes to wing walls 136. A similar arrangement may be used aboard the watercraft.

A pair of walkways 148 may cap the pair of wing walls 136. Walkways 148 may include any suitable walking surface formed on or attached to wing walls 136. In some embodiments, each walkway 148 may be rectangular and box-shaped, approximately two feet high and four feet wide to correspond to a width of the underlying upright tanks. In some examples, only one walkway may be present. Walkways 148 may include non-skid decking material. Walkways 148 may include other safety features configured to facilitate working on or around watercraft 124. For example, walkways 148 may each include one or more handrails 150, as well as any suitable bitts, bollards, and the like. Walkways 148 may include other features configured to provide visibility or indicate the extent of the dry dock when partially submerged.

Dry dock 100 may include supplemental buoyancy and/or stability elements. For example, one or more floats 152 may be included or integrated into the structure of dry dock 100. Floats 152 may include any suitable lightweight, self-buoyant structure or device configured to offset the weight of the dry dock and provide additional lifting capacity while still allowing the dock to be submerged by flooding flotation modules 102. In some embodiments, floats 152 include blocks of foam (e.g., expanded polystyrene (EPS)). The EPS blocks may be enclosed, such as in plastic shrink-wrap, to maintain integrity. Floats 152 may be disposed in any suitable location on the dry dock. The inventor has found that placing floats under the area of keel support assembly 104 may be suitable. Floats 152 may be included under walkways 148, or along outer portions of wall(s) 134. Floats in these areas may comprise reserve buoyancy.

Stability control of the overall structure may be enhanced by one or more interstitial tanks 154. When raising watercraft 124 on dry dock 100, the watercraft is initially stable due to being supported by the water. However, at some point, as the water level drops, the vessel hull is no longer supported adequately by the surrounding water. At this point, stability must be maintained by the structure of the dry dock itself. As the dry dock initially takes on the role of stable support for the vessel, misalignment or other factors may cause the dry dock to list or roll. Accordingly, it may be beneficial to include interstitial tanks 154, which may include any suitable structure configured to provide controllable and variable buoyancy at outer edges of the dry dock structure. For example, as shown in FIG. 3, interstitial tanks 154 may include a rectangular, open-bottomed tank having a valve 156 at an upper surface for venting. A selected number of these tanks may be included, and valve 156 may initially be closed, such that the empty tank remains at least partially filled with air as the dry dock is submerged. Upon raising of dry dock 100, valves 156 on interstitial tanks 154 may be selectively opened to reduce the selected tank(s) buoyancy and compensate for any stability problems that are encountered or anticipated.

Various props, blocks, chocks, and the like may be utilized to maintain the position of watercraft 124 within dry dock 100. For example, lateral props 158, depicted in FIG. 4, may be operatively connected to wing walls 136. Lateral props 158 may include any suitable structure or device configured to brace watercraft 124 laterally against the wing walls. For example, a telescoping, tubular brace may be used. A telescoping prop may fixable at a set of selectable lengths, such as using a cotter pin and a series of holes. To prevent damage to the watercraft, props 158 may include a padded end portion 160. End portions 160 may include a resilient surface. In some embodiments, end portions 160 are articulated to better conform to the shape of the watercraft. In some embodiments, props 158 may be vertically and/or horizontally adjustable along a portion of the wing wall. For example, props 158 may be operatively connected to a vertical channel or track, and may therefore have an adjustable height.

Dry dock 100 may include one or more structural braces 162 on or between other components. Braces 162 may include any suitable rigid structures configured to maintain spacing, orientation, and/or structural integrity of the flotation modules and other elements of dry dock 100. For example, braces 162 may include cross-braces formed between flotation modules along wing walls 136, as depicted in FIG. 3.

Figure 6:
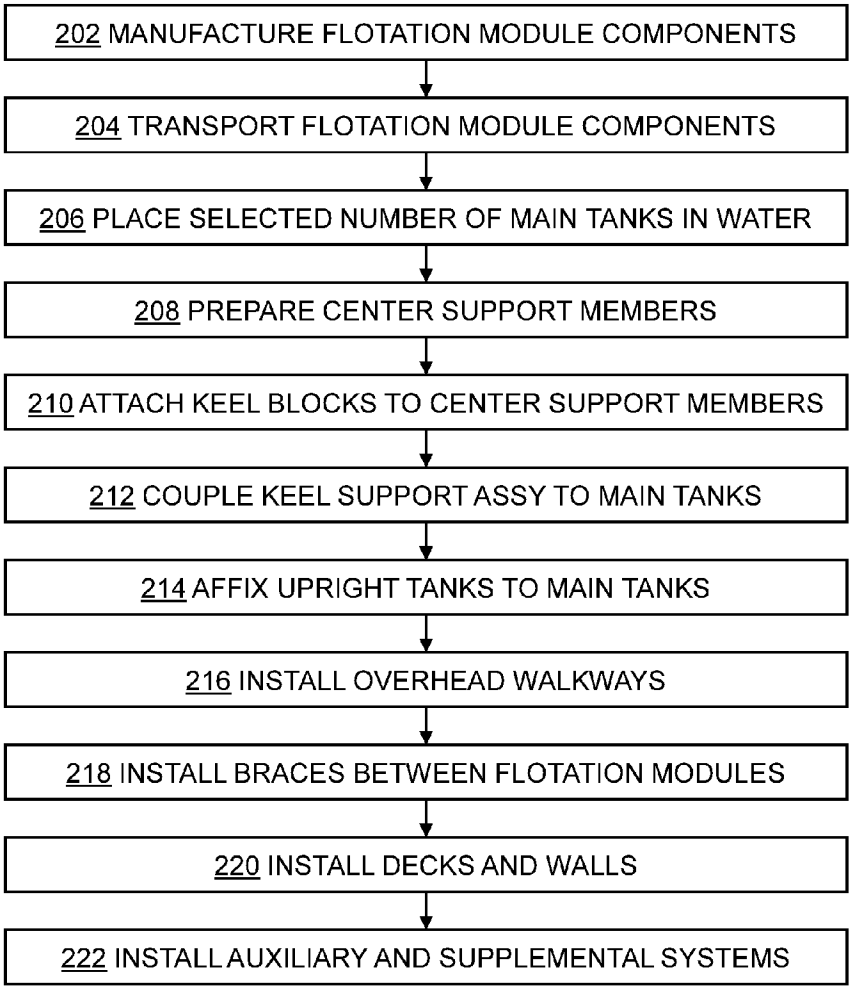
FIG. 6 is a flow chart of steps performed in an illustrative method for manufacturing a floating dry dock in accordance with aspects of the present disclosure.

Section 2:

This section describes a method for assembly of an enclosed, modular dry dock; see FIG. 6. Aspects of floating dry docks 10 and 100 may be utilized in the method steps described below. Where appropriate, reference may be made to previously described components and systems that may be used in carrying out each step. These references are for illustration, and are not intended to limit the possible ways of carrying out any particular step of the method.

FIG. 6 is a flowchart illustrating steps performed in an illustrative method, and may not recite the complete process or all steps of the process. FIG. 6 depicts multiple steps of a method, generally indicated at 200, which may be performed in conjunction with floating dry docks according to aspects of the present disclosure. Although various steps of method 200 are described below and depicted in FIG. 6, the steps need not necessarily all be performed, and in some cases may be performed in a different order than the order shown.

At step 202, flotation module components may be manufactured. For example, transverse tanks 106 as described above (also referred to as main tanks) may be manufactured in a factory or shop environment, using methods known in the art. Upright tanks 108 and 110 may be manufactured in similar fashion.

At step 204, the flotation module components may be transported to a desired location. For example, a selected number of the main tanks and upright tanks may be placed on a flatbed truck or other suitable vehicle and transported over standard roads to a desired destination. The number of flotation module components may be selected to correspond to a size and/or displacement of the type of watercraft expected to be supported by the dry dock. The desired destination may include a shore facility or a location on or near a body of water where the dry dock will be assembled and/or used.

Transportation of the flotation module components over the road is made possible by the modular nature of the dry dock. For example, the main and upright tanks may be rectangular tanks sized to fit on a standard truck or trailer. For example, main tanks may have approximate measurements of 36 feet long (i.e., end to end) by four feet high (i.e., top to bottom) by six feet deep (i.e., front to back). For example, upright tanks may have approximate measurements of eight feet tall (i.e., top to bottom) by four feet wide (i.e., side to side) by six feet deep (i.e., front to back). Step 204 may include shipping or transport of other components of the dry dock (e.g., decking materials, pneumatic plumbing materials, etc.). For example, some or all components may be shipped or transported as a kit.

At step 206, a selected number of main tanks may be placed into the body of water. For example, five transverse tanks 106 may be sealed and floated into desired position. Sealing may include installation of removable (e.g., pop-out) seals into selected openings in the tanks. Sealing may be partial in nature. For example, one or more openings may be present in the tanks above the waterline. As mentioned above, the number of flotation modules chosen may be based on a desired size and/or lifting capacity. This number of modules may be selected prior to transport, and the number of tanks and other components may be based on the number chosen.

At step 208, the center support members (e.g., I-beams), also referred to as beams, may be prepared. For example, multiple beams may be welded end-to-end to create each support member of desired length. These beams correspond to members 116 and 118 described above. In some examples, only a single center support member may be prepared and used in following steps.

At step 210, a plurality of keel blocks (also referred to as crosspieces) may be attached to the center support members. For example, the pair of center support members may be placed in parallel, side-by-side. Keel blocks (e.g., keel blocks 120) may then be tack welded along the center support members at a selected spacing. For example, keel blocks may be placed every seven feet. Other spacings may be suitable. The keel blocks and center support members together may form a keel support assembly, as described above.

At step 212, the main tanks and keel support assembly may be brought together, temporarily braced in a desired arrangement, and permanently coupled. For example, the main tanks may be spaced along the length of the keel support assembly at selected intervals, and braced such that the various components are squared and aligned. Then, the main tanks may be welded to the keel support assembly by welding the center support beams into corresponding channels in an upper surface of each main tank. The temporary bracing may be removed after welding.

As mentioned above, steps of method 200 may be performed in a different order than that described here. As an example, steps 210 and 212 may be performed in a different order. For example, the keel blocks may be attached to the center support members after the center support members are permanently coupled to the main tanks. At step 214, a pair of upright tanks may be positioned and affixed to each of the main/transverse tanks. For example, an upright tank may be placed atop each end of each main tank, and welded in place to form U-shaped flotation modules.

At step 216, a pair of overhead walkways may be prepared and installed. For example, a selected number of smaller sections (e.g., four sections) of walkway may be welded or otherwise affixed end-to-end to form a walkway corresponding to the length of the dry dock (e.g., walkways 148). The walkways may then be placed onto the upright tanks and welded, bolted, or otherwise fixed in place. The walkways may form caps on the wing walls defined by the uprights along each lateral edge of the floating dry dock.

At step 218, braces may be installed between flotation modules. For example, permanent cross-braces (e.g., braces 162) may be fixed between tanks to provide structural support and to maintain spacing and orientation of the flotation modules. This step may include installing framework on and/or between the tanks. The framework may because configured to support decks and walls of the structure.

At step 220, decks and walls may be installed. For example, decking materials may be attached to the framework installed in step 218. For example, Trex® deck planks (or the like) may be screwed or otherwise affixed to the framework to form interstitial decks and/or walls. This step may include caulking any gaps or seams formed in the decks and/or walls.

At step 222, auxiliary and supplemental systems may be installed. For example, pneumatic piping, valve control panel(s), ventilation system supports, one or more blowers, pumps, valves, fans, and/or scrubbers may be installed in the dry dock. For example, draping support systems may be installed, such as tie-downs, support cables, and the like. Shut-off valves may be installed at the various tanks. For example, butterfly valves may be installed to function as safety back-up valves in the event of a pneumatic piping breach. Floats (e.g., foam blocks 152) may be installed in desired locations, as described above, to supplement buoyancy and offset the weight of the dry dock structure. Supplemental interstitial tanks (e.g., tanks 154) may be installed between flotation modules to supplement control of stability during boat-raising operations.

Figure 7:
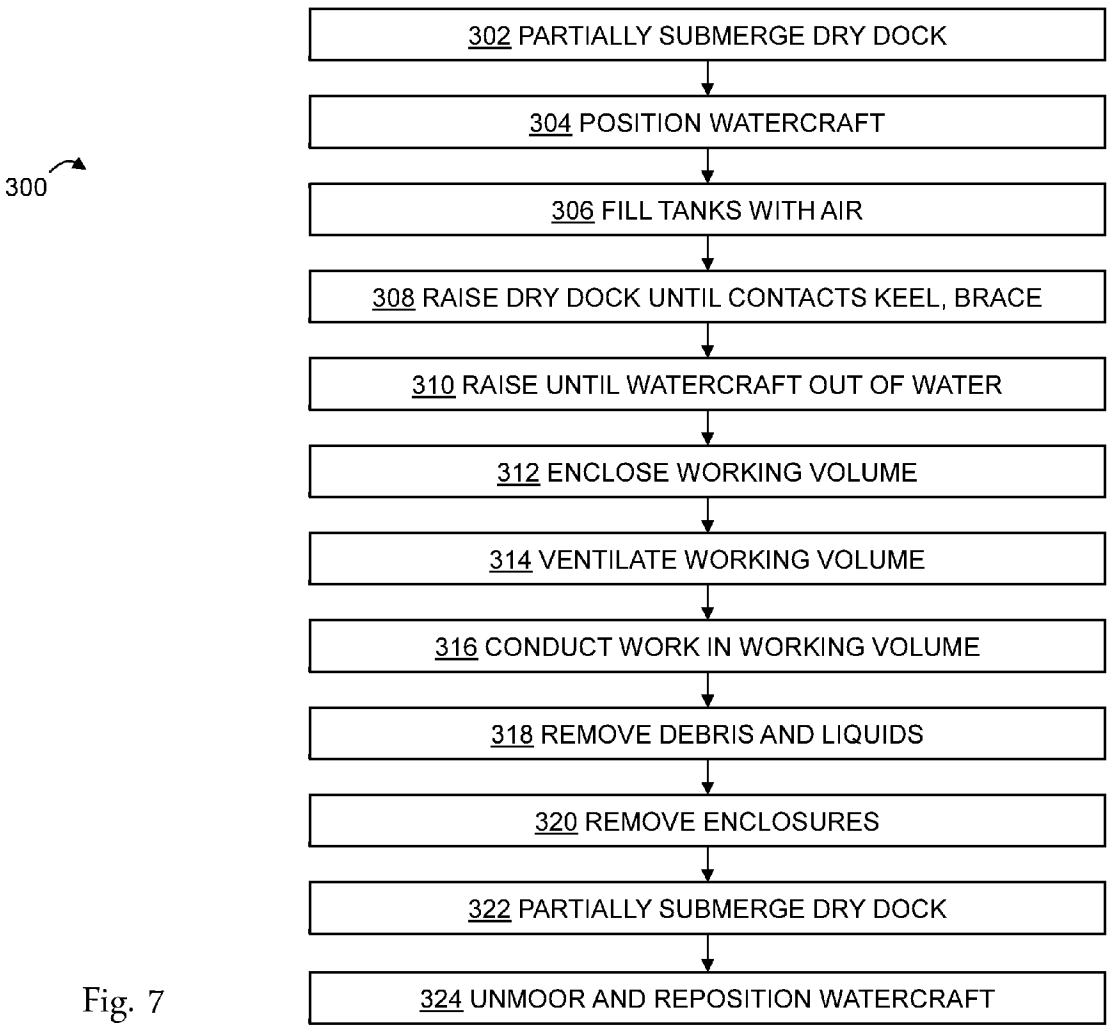
FIG. 7 is a flow chart of steps performed in an illustrative method for using a floating dry dock in accordance with aspects of the present disclosure.

Section 3:

This section describes a method for use of an enclosed, modular dry dock; see FIG. 7. Aspects of floating dry docks 10 and 100 may be utilized in the method steps described below. Aspects of method 200 may be utilized in conjunction with the method steps described below. Where appropriate, reference may be made to previously described components and systems that may be used in carrying out each step. These references are for illustration, and are not intended to limit the possible ways of carrying out any particular step of the method.

FIG. 7 is a flowchart illustrating steps performed in an illustrative method, and may not recite the complete process or all steps of the process. FIG. 7 depicts multiple steps of a method, generally indicated at 300, which may be performed in conjunction with floating dry docks according to aspects of the present disclosure. Although various steps of method 300 are described below and depicted in FIG. 7, the steps need not necessarily all be performed, and in some cases may be performed in a different order than the order shown.

At step 302, the floating dry dock may be partially submerged by flooding one or more tank portions of the flotation modules. For example, all valves may be placed in a "flood" position, causing the various tanks to vent and sink. Valve positioning may be controlled at a central control panel. In some examples, the floating dry dock will sink to a point where the waterline is just below the wing wall walkways.

At step 304, a watercraft may be positioned over the submerged deck of the dry dock, between the wing walls. This step may include mooring the boat or other vessel to the dry dock. For example, mooring lines may be attached to bitts or bollards on the walkways or wing walls. Mooring lines may be positioned to align the watercraft laterally and/or longitudinally within the dry dock.

At step 306, valves may be repositioned to a "fill" position, and air may be pumped or blown into the tanks. Step 306 may include filling the upright tanks prior to filling the transverse tanks, for stability reasons.

At step 308, the dry dock may be raised until the keel contacts the keel support assembly (e.g., the keel blocks), and the watercraft may be braced in position. This step may include pausing the filling of tanks, such as by repositioning valves to a neutral or closed position. At the point where the keel blocks strike the keel, the boat will be balanced and stable, as it is still fully supported by the surrounding water. The watercraft may be braced or propped in position using any suitable devices or structures. For example, adjustable length beams (e.g., props 158) may be utilized. In some examples, additional props, blocks, wedges, and/or the like may be used.

At step 310, the dry dock will continue to be raised until the watercraft is out of the water entirely. This step may include employment of supplemental stability methods or devices. For example, interstitial tanks (e.g., tanks 154) may be controllably flooded to compensate for stability fluctuations as the craft loses waterborne support. When the dry dock is afloat at the desired level, filling operations may be secured. Safety valves such as tank shut-off valves may be closed in this step to prevent tank flooding in the event of a fill/vent system breach.

At step 312, the working volume around the watercraft may be enclosed or contained. This step may include installation or positioning of drapes. As described above, drapes (e.g., drapes 140) may include any suitable impermeable membrane or sheet configured to environmentally enclose the volume around the watercraft and interior to the dry dock.

Drapes may be secured using any suitable method, such as using tie-downs, sand bags, etc., as described above.

At step 314, the dry dock ventilation system may be placed into service. In other words, active ventilation of the enclosed working volume may be commenced and maintained. Ventilating the working volume may include pulling air from the space using a fan. Ventilating the working volume may include maintaining a pressure differential such that pressure within the working volume is slightly less than surrounding atmospheric pressure. Ventilating the working volume may include passing the ventilated air through a scrubber system and/or other environmental controls, for example to neutralize or remove pollutants and contaminants before exhausting the air into the environment.

At step 316, work may be conducted within the enclosed working volume. For example, the watercraft may be repaired or maintained. Activities may be conducted, such as welding, brazing, chipping, sandblasting, washing, cleaning, painting, and the like, or any combination of these. This step may include substantially containing the solid, liquid, and/or airborne contaminants generated by the work being conducted, such that these contaminants do not escape into the surrounding environment. This containment may be accomplished by various methods already described. For example, physical containment may be achieved using the structure of the dry dock and drapes, including any suitable sumps. Airborne containment may be achieved using the scrubber and ventilation system.

At step 318, debris and liquid waste may be removed from the dry dock. For example, solids may be removed by manual transport and/or industrial vacuum. Liquid waste may be pumped or otherwise removed offsite. The interior of the working volume may be cleaned.

At step 320, the drapes may be removed and the ventilation system may be secured, in preparation for submerging the dry dock. Any remaining equipment, tools, and personnel will be removed from the working volume.

At step 322, the floating dry dock may again be partially submerged by flooding one or more tank portions of the flotation modules. This step may be substantially identical to step 302, with the exception that the watercraft is still attached to the dry dock as the tanks are flooded. Step 322 may include unblocking or unbracing the watercraft as the water begins to provide stability support. Submergence of the floating dry dock may be continued until the watercraft is completely supported by the surrounding water.

At step 324, the watercraft may be unmoored from the dry dock, piloted out from between the wing walls, and allowed to proceed underway as desired.

Section 4:

This section describes additional aspects and features of enclosable, modular, floating dry docks, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A floating dry dock comprising:

a pair of side-by-side elongate members defining a central axis; and a plurality of U-shaped flotation modules disposed in a spaced relationship along the central axis, each flotation module including a transverse tank, a first upright tank disposed at a first end of the transverse tank and a second upright tank disposed at a second end of the transverse tank, each transverse tank being coupled to the pair of elongate members such that a respective gap is formed between each pair of adjacent flotation modules;

wherein each gap includes a first void between adjacent transverse tanks, the first void being spanned by a deck, and a second void between adjacent upright tanks, the second void being spanned by a wall.

A1. The floating dry dock of paragraph A0, wherein each of the transverse tanks has a first width measured parallel to the central axis, each of the gaps has a second width measured parallel to the central axis, and the second width is greater than the first width.

A2. The floating dry dock of any of paragraphs A0-A1, further including a plurality of keel blocks coupled to the pair of elongate members at spaced intervals.

A3. The floating dry dock of any of paragraphs A0-A2, further including one or more flexible sheets releasably attachable to the floating dry dock.

A4. The floating dry dock of any of paragraphs A0-A1, further including a first walkway coupled to the first upright tanks, and a second walkway coupled to the second upright tanks.

A5. The floating dry dock of any of paragraphs A0-A4, further including one or more floats coupled to the dry dock and configured to provide buoyancy that offsets a weight of the dry dock.

A6. The floating dry dock of paragraph A5, wherein the one or more floats include a plurality of expanded polystyrene blocks.

A7. The floating dry dock of paragraph A5 or A6, wherein the one or more floats are disposed below the pair of side-by-side elongate members.

B0. A floating dry dock system comprising:

a floating dry dock including a pair of wing walls, a deck connecting lower end portions of the pair of wing walls, and a plurality of flotation tanks integrated with the deck and wing walls at spaced intervals along a length of the floating dry dock;

one or more flexible, impermeable sheets coupled to the dry dock;

a watercraft supported by the floating dry dock between the wing walls; and a working volume defined between an outer surface of the watercraft and an inner surface of the dry dock;

wherein the working volume is enclosed by the one or more impermeable sheets.

B1. The system of paragraph B0, wherein each of the flotation tanks includes a U-shaped tank, and the spaced intervals are configured such each gap between the flotation tanks is larger than one of the flotation tanks.

B2. The system of any of paragraphs B0-B1, further including a plurality of buoyant floats coupled to the floating dry dock and configured to offset a weight of the dry dock.

B3. The system of paragraph B2, wherein the buoyant floats comprise foam blocks.

B4. The system of paragraph B2 or B3, wherein the buoyant floats are disposed below a portion of the deck.

B5. The system of any of paragraphs B0-B4, further including a pair of walkways capping the pair of wing walls.

B6. The system of paragraph B5, further including a plurality of expanded polystyrene blocks coupled to the pair of walkways.

C0. A method of manufacturing a floating dry dock, the method comprising: placing a plurality of substantially identical elongate tanks into a body of water; coupling each of the elongate tanks to a keel support assembly having at least one elongate support member defining a long axis, such that the elongate tanks are spaced along the elongate support member and oriented transverse to the long axis, forming a respective gap between each adjacent pair of the elongate tanks;

forming a plurality of U-shaped flotation modules by attaching an upright tank to each end portion of each of the elongate tanks; and covering the gap between each adjacent pair of elongate tanks with one or more decking materials.

C1. The method of paragraph C0, further including selecting a number of elongate tanks corresponding to a desired lifting capacity of the floating dry dock being manufactured; and transporting the selected number of elongate tanks and a corresponding number of upright tanks over standard roads to the body of water.

C2. The method of any of paragraphs C0-C1, wherein the one or more decking materials comprise a plurality of decking planks.

C3. The method of paragraph C2, wherein the decking planks comprise a composite of wood and plastic.

C4. The method of any of paragraphs panarteriitis nodosa C0-C3, wherein forming the plurality of U-shaped flotation modules includes forming a respective space between successive upright tanks attached to adjacent elongate tanks, and further including covering the space between successive upright tanks with one or more wall materials.

C5. The method of any of paragraphs C0-C4, wherein the keel support assembly further includes a plurality of cross beams affixed at spaced intervals to the at least one elongate support member.

C6. The method of any of paragraphs C0-C5, further including coupling one or more drapes to the dry dock, the one or more drapes configured to enclose a chamber formed between an inner surface of the dry dock and a watercraft supported by the dry dock.

D0. A method of limiting environmental impact when performing work on a watercraft, the method including:

raising a watercraft out of a body of water using a floating dry dock;

enclosing a working volume around the watercraft by draping one or more impermeable sheets between the watercraft and the dry dock;

ventilating the working volume using a forced ventilation system configured to maintain an internal pressure in the working volume lower than an external atmospheric pressure;

containing debris and liquids generated within the working volume using one or more structures of the floating dry dock;

D1. The method of paragraph D0, further including removing the debris and liquids contained within the working volume.

D2. The method of paragraph D1, wherein removing the debris includes using a vacuum cleaner.

D3. The method of any of paragraphs D0-D2, wherein ventilating the working volume includes passing air from the working volume through a scrubber.

D4. The method of any of paragraphs D0-D3, further including constructing the floating dry dock using a selected number of flotation modules.

D5. The method of paragraph D4, further including selecting the number of flotation modules based on a displacement of the watercraft to be raised.

D6. The method of any of paragraphs D0-D5, wherein containing the liquids generated within the working volume includes containing the liquids in one or more sumps of the floating dry dock.

E0. An intermediate article of manufacture for assembling a floating dry dock, the article comprising:

a keel support assembly having at least one elongate support member defining a long axis;

a plurality of elongate flotation tanks coupled to the keel support assembly, such that the flotation tanks are spaced along the elongate support member and oriented transverse to the long axis, forming a respective gap between each adjacent pair of the flotation tanks.

E1. The article of paragraph E0, wherein each of the elongate flotation tanks is floodable.

E2. The article of any of paragraphs E0-E1, wherein the keel support assembly includes two side by side elongate support members.

E3. The article of any of paragraphs E0-E2, wherein each of the elongate flotation tanks is rectangular.

E4. The article of any of paragraphs E0-E3, wherein each of the gaps has a first width measured parallel to the long axis, each of the elongate tanks has a second width measured parallel to the long axis, and the first width is greater than or equal to the second width.

E5. The article of any of paragraphs E0-E4, further including a plurality of upright tanks, each of the upright tanks attached to a respective end portion of one of the elongate tanks.

Advantages, Features, Benefits

The different embodiments of the floating dry dock described herein provide several advantages over known solutions for assembling small dry docks and for providing environmental containment when working on watercraft. For example, the illustrative embodiments of a modular dry dock described herein allow on-site assembly of modular components to create a custom-sized dry dock for boats in the 30- to 100-ton range, e.g., using anywhere from two to six flotation modules having dimensions described above. For example, flotation modules or tanks, as well as other major components may be transportable over land using standard trucking equipment. Other elements may be transportable and/or available as standard off-the-shelf components as needed. Furthermore, some embodiments provide supplemental flotation and stability features, as described above. Additionally, and among other benefits, illustrative embodiments of the floating dry dock described herein allow simple and expedient environmental enclosure for a working volume around a watercraft in dry dock. No known system or device can perform these functions, particularly for watercraft of this size. Thus, the illustrative embodiments described herein are particularly useful for boat owners, moorages, dock facilities, and repair shops. However, not all embodiments described herein provide the same advantages or the same degree of advantage.

CONCLUSION

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

I claim:

1. A method of limiting environmental impact when performing work on a watercraft, the method including:

raising a watercraft out of a body of water using a floating dry dock having a pair of wing walls and a plurality of floodable transverse flotation tanks disposed at lower end portions of the pair of wing walls at spaced intervals along a length of the floating dry dock, a weight of the floating dry dock being at least partially offset by one or more self-buoyant floats coupled to the floating dry dock;

enclosing a working volume between an outer portion of the watercraft and an inner portion of the dry dock by coupling one or more flexible sheets to the dry dock and to the watercraft;

ventilating the working volume using a forced ventilation system configured to maintain an internal pressure in the working volume lower than an external atmospheric pressure; and containing debris generated within the working volume using the outer portion of the watercraft, the inner portion of the dry dock, and the one or more flexible sheets.

2. The method of claim 1, wherein coupling the one or more flexible sheets to the dry dock and to the watercraft includes draping at least one of the flexible sheets between the dry dock and the watercraft.

3. The method of claim 1, further including removing at least a portion of the debris contained within the working volume using a vacuum cleaner.

4. The method of claim 1, further comprising containing liquids generated within the working volume using the outer portion of the watercraft, the inner portion of the dry dock, and the one or more flexible sheets.

5. The method of claim 4, wherein the inner portion of the dry dock includes a sump.

6. The method of claim 1, wherein ventilating the working volume includes passing air from the working volume through a scrubber.

7. A method of environmentally segregating a watercraft from a body of water, the method including:

raising a watercraft out of a body of water using a floating dry dock, a weight of the dry dock being at least partially offset by one or more self-buoyant floats coupled to the dry dock;

supporting the watercraft on the floating dry dock on one or more keel blocks between a pair of wing walls above a substantially continuous floor comprising a deck and a plurality of transverse tanks; and reducing contamination of the body of water from the watercraft by enclosing a working volume, such that an outer boundary of the working volume is formed by an inner portion of the floating dry dock.

8. The method of claim 7, wherein enclosing the working volume comprises enclosing the working volume between an outer portion of the watercraft, the floor of the floating dry dock, and the pair of wing walls of the floating dry dock by draping one or more flexible sheets between the watercraft and the floating dry dock.

9. The method of claim 7, wherein the at least one self-buoyant float is coupled to the floating dry dock below a waterline.

10. The method of claim 7, wherein reducing contamination of the body of water further includes maintaining an internal pressure of the working volume lower than an external atmospheric pressure using a forced ventilation system.

11. The method of claim 10, wherein using the forced ventilation system includes passing air from the working volume through a scrubber.

12. The method of claim 7, wherein the one or more self-buoyant floats comprise a block of foam encased in plastic.

13. The method of claim 7, wherein the one or more self-buoyant floats comprise expanded polystyrene.

14. The method of claim 7, wherein each of the wing walls has a respective, substantially continuous inner surface comprising an upright tank and a wall portion.

15. A method for limiting environmental contamination when performing work on a watercraft, the method comprising:

supporting a watercraft above a body of water on a keel support assembly of a floating dry dock having a plurality of controllably floodable transverse flotation tanks coupled at spaced intervals to the keel support assembly along a length of the floating dry dock, a plurality of naturally buoyant floats being disposed below the keel support assembly, such that a buoyancy of the plurality of naturally buoyant floats at least partially offsets a weight of the floating dry dock; and preventing debris from passing from the watercraft into the body of water by enclosing a working volume between the watercraft and an interior portion of the floating dry dock.

16. The method of claim 15, wherein gaps between adjacent ones of the transverse flotation tanks are covered by a decking material.

17. The method of claim 15, wherein enclosing the working volume comprises draping a plurality of flexible sheets between the watercraft and the floating dry dock.

18. The method of claim 15, further comprising preventing liquids from passing from the working volume to the body of water by containing the liquids on a deck portion of the floating dry dock.

19. The method of claim 15, the floating dry dock further comprising a respective pair of upright stabilizer tanks coupled to opposing end portions of each of the transverse flotation tanks.

20. The method of claim 19, wherein gaps between adjacent ones of the upright stabilizer tanks are each spanned by a respective wall.

* * * * *